US006286286B1

(12) United States Patent
Simonar

(10) Patent No.: US 6,286,286 B1
(45) Date of Patent: Sep. 11, 2001

(54) APPARATUS FOR MOUNTING ARCHITECTURAL MOLDINGS

(76) Inventor: David Murray Simonar, 436 Butchart Dr., Edmonton (CA), T6R 1R2

( * ) Notice: Subject to any disclaimer, the term of this patent is extended or adjusted under 35 U.S.C. 154(b) by 0 days.

(21) Appl. No.: 09/421,618

(22) Filed: Oct. 19, 1999

(30) Foreign Application Priority Data

Oct. 28, 1998 (CA) ..... 2.252.016

(51) Int. Cl.[7] ..... E04C 2/38

(52) U.S. Cl. ..... 52/716.1; 52/287.1; 52/288.1; 52/718.05

(58) Field of Search ..... 52/287.1, 288.1, 52/718.01, 718.05, 718.02, 716.1; 256/1

(56) References Cited

U.S. PATENT DOCUMENTS

| | | | | |
|---|---|---|---|---|
| 2,298,743 | * | 10/1942 | Lichtor | 52/287.1 X |
| 3,478,395 | * | 11/1969 | Flora | 52/718.05 X |
| 3,501,186 | * | 3/1970 | Wilcox et al. | 52/718.05 |
| 4,308,704 | | 1/1982 | Lloyd | 52/717.03 |
| 4,706,426 | * | 11/1987 | Rumsey | 52/288.1 X |
| 5,348,066 | * | 9/1994 | Wilson | 52/288.1 X |
| 5,467,571 | | 11/1995 | Khatibi | 52/718.04 |
| 5,664,376 | * | 9/1997 | Wilson et al. | 52/288.1 X |
| 5,711,123 | | 1/1998 | Lamont et al. | 52/287.1 |
| 5,771,646 | * | 6/1998 | DeSouza | 52/288.1 X |

FOREIGN PATENT DOCUMENTS

| | | | |
|---|---|---|---|
| 2142384 | 2/1995 | (CA) | F16B/5/12 |

* cited by examiner

*Primary Examiner*—Peter M. Cuomo
*Assistant Examiner*—Stephen Vu
(74) *Attorney, Agent, or Firm*—Christensen O'Connor Johnson Kindness PLLC

(57) ABSTRACT

An apparatus is provided for mounting architectural moldings. A molding is provided with a retaining groove. A two part fastener is provided having a female portion and a male portion. The female portion is asymmetrical with a first width in a first direction that is less than a narrowest width of the retaining groove and a second width in a second direction larger than the narrowest width of the retaining groove. The female portion is inserted into the retaining groove when oriented in the first direction. The female portion is then rotated within the retaining groove until the female portion is wedged in the retaining groove in the second direction and thereby precluded from removal. The male portion is mounted to a surface prior to mating with the female portion.

20 Claims, 5 Drawing Sheets

APPARATUS FOR MOUNTING ARCHITECTURAL MOLDINGS

FIELD OF THE INVENTION

The present invention relates to a method and an apparatus for mounting architectural moldings.

BACKGROUND OF THE INVENTION

Architectural moldings are used in the construction of all residential and commercial buildings. They are used to cover gaps in construction associated with the joining of walls with ceilings, floors, doors, and windows; and are also used for decorative purposes.

There are various existing methods of attaching molding to flat surfaces with the most common being, nailing, stapling, screwing and gluing. In all of the common methods of attaching molding, the desired result is a semi-permanent installation. With the exception of gluing on molding, most of the methods of installing molding involve penetration by nails, staples, screws or other fasteners through the front face of the molding. As a result, the surface of the molding is blemished. In order to hide the blemish, the nail, staple or screw is covered by a filler material and the front face of the molding is refinished.

Once molding is attached with the above methods, and it needs to be removed, there is normally some form of damage sustained by the molding during removal. Since the molding has to be pried and pulled from the flat surface there is commonly cracking, breaking or disfiguring of the molding material. When the molding is replaced the same process as was originally used to put the molding on must be employed.

The attaching of molding by gluing does not involve penetration that would blemish the front face of the molding. However, as with the above described methods of attachment, the glued molding is hard to remove. During removal of the molding damage is invariably sustained to both the molding and the surface to which the molding was glued.

The above described difficulties in removing moldings arise every time renovations are undertaken that involve painting, wallpapering, or refinishing walls, or modifying floor coverings. In order to avoid removing moldings, people will apply masking or shielding on the molding when jobs such as painting of walls are undertaken. This procedure dramatically increases the amount of labor, and consequently the cost, associated with the renovation. Even with masking, care is required in order to avoid getting paint on the molding.

In order to avoid the above described problems some removable molding systems have been developed. U.S. Pat. No. is 5,467,571 granted to Khatibi describes the use of a round headed screw which engages with a female snap component. The design was meant to be reversible in roles where the round headed screw could be fastened to the back face of the molding or to the face of the flat mounting surface. In either case the female snap component would be attached to the opposite piece. The main problem with Khatibi's design is that most molding is so thin that whether the round headed screw is screwed into the molding or the female component is set into the molding it would adversely affect the strength characteristics of the molding. In order for the female component to be imbedded completely into the molding, the molding must be sufficiently thick that the integrity of the molding is not compromised. There will be a similar problem with installation of the round headed screw, due to the depth that the shank of the screw must penetrate the molding. The screw tends to promote splitting or splintering of thin molding. There are other problems also associated with the Khatibi design. A number of different tools are required to complete the installation. The craftsman installing the female component has to be very exact while drilling holes into the mounting surfaces, so as to allow proper mating of the male and female components. U.S. Pat. No. 5,711,123 granted to Lamont et al is characterized by an elongate channel recessed into the front face of the moulding. The channel is adapted to releasably retain an elongate strip-like panel. The channel is defined by upper and lower side walls and a recessed floor. The side walls partly occlude the mouth of the channel and serve to retain the panel within the channel. This design is both expensive to make and expensive to install. There are a limited number of moldings that can be manufactured in 1accordance with the teachings of Lamont et al. The main reason for this is that most of the existing molding available is so thin that its integrity will be severely compromised.

Canadian Patent Application 2,142,384 by David M. Simonar entitled "Molding Fastener System" disclosed a molding fastener system that utilized snap fasteners. The system addressed a number of problems in the prior art in that it had a compact profile that could be used with thinner styles of molding. The problem with the system was that it involved too many component pieces and, as such, was labour intensive to install.

SUMMARY OF THE INVENTION

What is required is an alternative form of architectural molding fastener system.

According to one aspect of the present invention there is provided a method for mounting architectural moldings. A molding is provided with a retaining groove. A two part fastener is provided having a female portion and a male portion. The female portion is asymmetrical with a first width in a first direction that is less than a narrowest width of the retaining groove and a second width in a second direction larger than the narrowest width of the retaining groove. The female portion is inserted into the retaining groove when oriented in the first direction. The female portion is then rotated within the retaining groove until the female portion is wedged in the retaining groove in the second direction and thereby precluded from removal. The male portion is mounted to a surface prior to mating with the female portion.

The method, as described above, provides a simple and unobtrusive mode of attachment for the molding that can easily be detached when required to facilitate household maintenance. Unlike the previous system by Simonar the insertion of the female portions of the two part fasteners into the retaining groove can be performed rapidly.

Although beneficial results may be obtained through the use of the method, as described above, manually exerting a force to rotate the female portions can be awkward. Even more beneficial results may, therefore, be obtained when the female portion has a surface profile that accommodates a tool and permits the female portion to be rotated by the tool like a rotatable fastener. This saves wear and tear on the installers fingers and permits more torque to be applied.

Although beneficial results may be obtained through the use of the method, as described above, if a force of sufficient magnitude acted upon the female portion of the two part fastener, it would be dislodged from the retaining groove.

Even more beneficial results may, therefore, be obtained when the retaining groove is a dovetail groove having a base portion that defines a maximum width and a terminus of converging sidewalls that define a narrowest width. It is much more difficult to dislodge the female portion from such a dove-tail groove.

Although beneficial results may be obtained through the use of the method, as described above, the holding effect of the dovetail groove can be even further enhanced when the female portion of the two part fastener has sidewalls which converge inwardly from a first face toward a second face. The first face has a width substantially corresponding to the maximum width of the dovetail retaining groove. The second face has a width substantially corresponding to the narrowest width of the dovetail retaining groove.

Although beneficial results may be obtained through the use of the method, as described above, there is a need to fasten moldings securely where they abut. Even more beneficial results may, therefore, be obtained when the moldings are connected by inserting a connecting member into the retaining grooves at a first end of a first molding and at a second end of a second molding. It will be appreciated that the connecting member can be linear for straight sections or angular for corner sections.

Although beneficial results may be obtained through the use of the method, as described above, even more beneficial effects can be obtained to holding power of the connecting member when the connecting member has flexible sidewalls defining a channel. The connecting member can then be secured in position within the retaining groove by inserting a male member into the channel to expand the flexible sidewalls outwardly to engage the retaining groove.

Although beneficial results may be obtained through the use of the method, as described above, even more beneficial results may be obtained when the male member has a groove in a back and top of it, thereby enabling a tool to be inserted in the male member to facilitate its removal from the connecting member.

Although beneficial results may be obtained through the use of the method, as described above, even more beneficial results may be obtained when a locator tack is provided having a base of sufficient size to fit inside a hole of the female portion of the two part fastener and a sharp point which is longer than a height of the retaining groove in the molding, thereby facilitating the marking of the fastening points of the male portions of the two part fastener to a surface.

According to another aspect of the present invention there is provided an apparatus for mounting architectural moldings. This apparatus includes, in combination, a molding with a retaining groove and a two part fastener having a female portion and a male portion. The female portion being asymmetrical with a first width in a first direction that is less than a narrowest width of the retaining groove and a second width in a second direction larger than the narrowest width of the retaining groove.

As described above, the functionality of the apparatus can be further enhanced by selected features. By providing the female portion with a tool receiving profile, the rapid insertion of the female portion can be facilitated. By making the retaining groove in a dovetail groove configuration, the holding power of the retaining groove can be improved. Further, the holding effect of the dovetail groove can be even further enhanced when the female portion is configured to more closely fit the dovetail groove. By providing a connecting member that is insertable the retaining grooves at a first end of a first molding and a second end of a second molding, the connection to moldings can be facilitated. By making connecting member with flexible sidewalls defining a channel, the connecting member can be locked in place by the insertion of a male member into the channel. By placing a groove in the male member, a tool may be inserted in the male member to facilitate its removal from the connecting member. By providing a locator tack that mates with the female portion of the two part fastener, the positioning of the male portion along a surface can be rapidly and accurately marked.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

A preferred embodiment of architectural molding and a preferred method of installing the same will now be described with reference to FIGS. 1 through 20.

Figure 1:
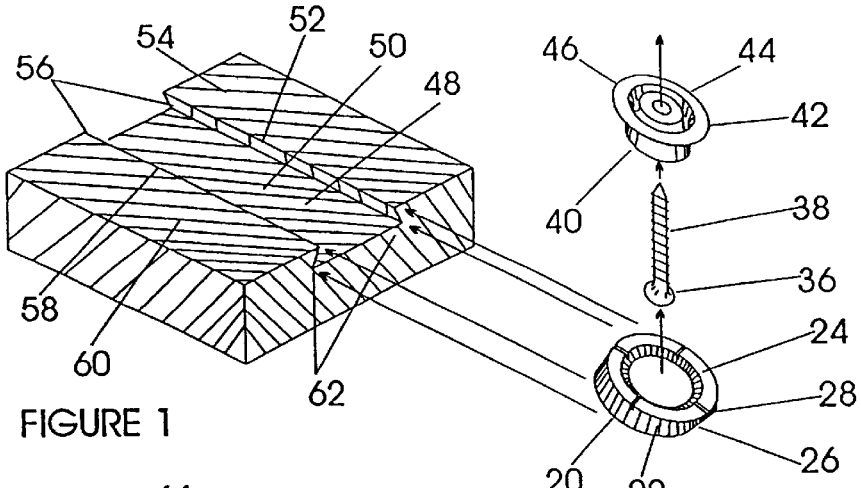
FIG. 1 is an exploded perspective view of the molding fastens system and how components fit together.
Figure 11:
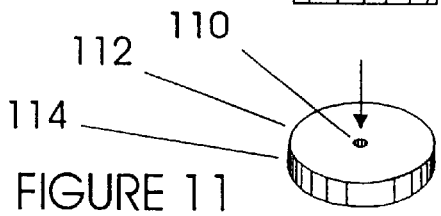
FIG. 11 is perspective view of male locator tack and centering washer.
Figure 12:
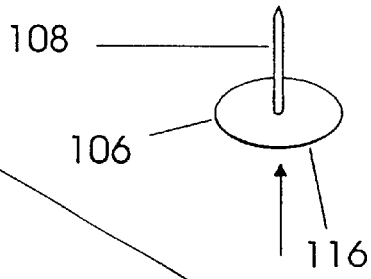
FIG. 12 is a perspective view of a flat 90° corner molding clip.
Figure 12:
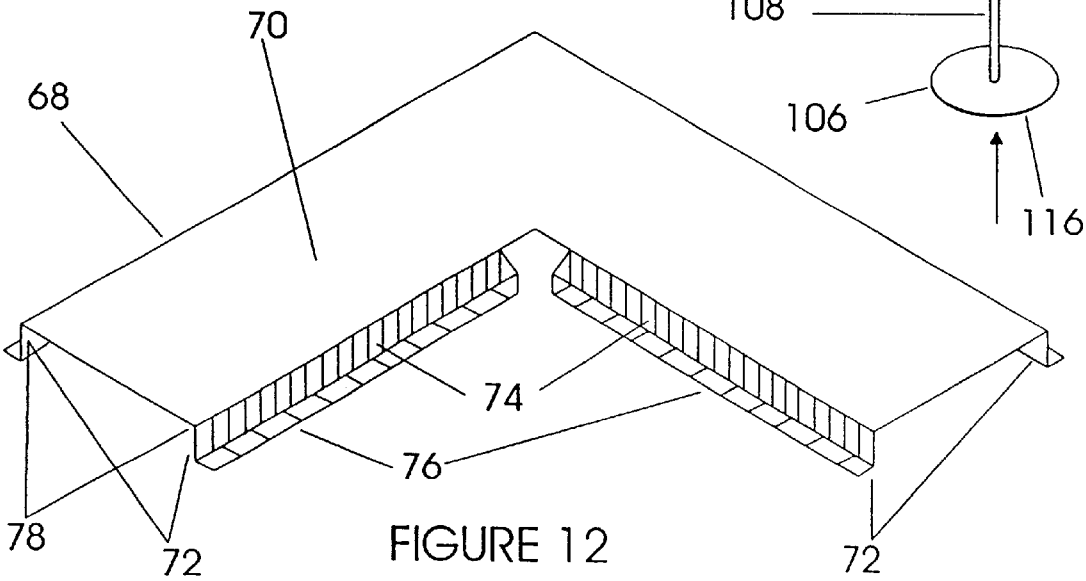
Figure 13:
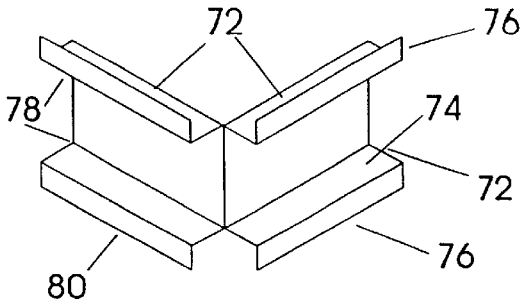
FIG. 13 is a perspective view of a 90° outside corner molding clip.
Figure 14:
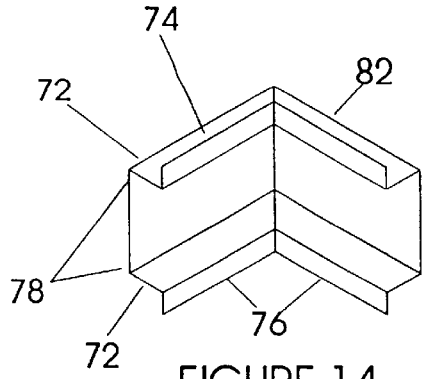
FIG. 14 is a perspective view of a 90° inside corner molding clip.
Figure 15:
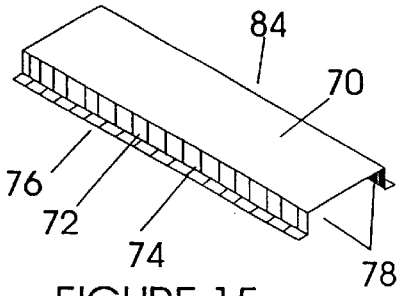
FIG. 15 is a perspective view of a straight run molding clip.
Figure 16:
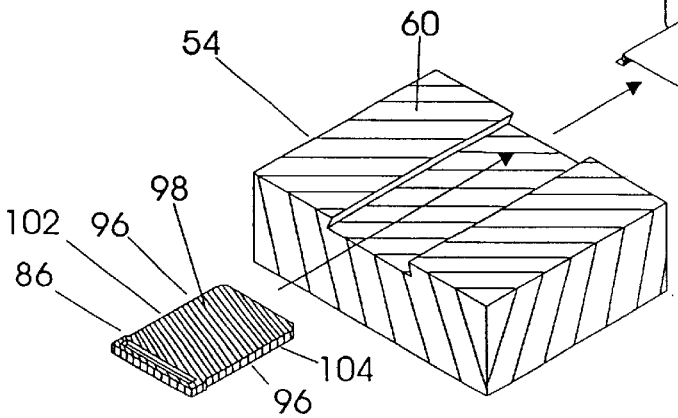
FIG. 16 is an exploded perspective view of an installation involving a straight molding clip, as in FIG. 15.
Figure 18:
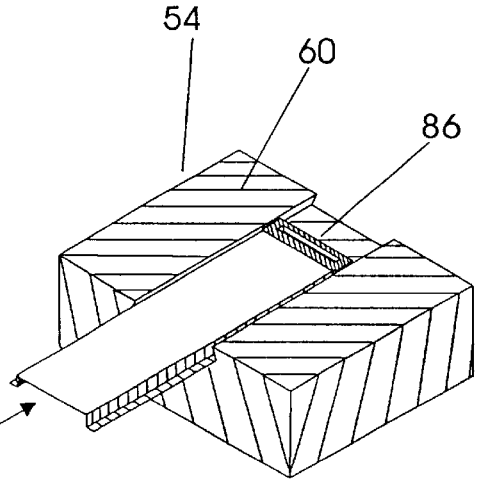
FIG. 18 a side elevation view of the molding clip holder assembly taken along section lines A—A of FIG. 17.
Figure 18:
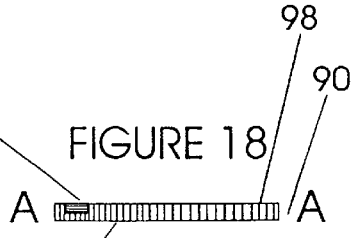
Figure 17:
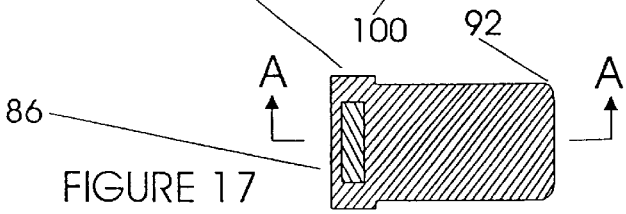
FIG. 17 is a top plan view, in section, of a molding clip holder assembly.

Referring to FIG. 1, the preferred embodiment uses a dovetail groove 48 made in the molding 54, a nail or screw 38, and a two part fastener system which has a female portion and a male portion. The male portion is hereinafter identified as a circular male snap 44 and the female portion is hereinafter referred to as a female molding snap 20. Various configurations of connecting members are provided in the form of molding clips for connecting pieces of molding 54 together: molding clip 68 is illustrated in FIG. 12, molding clip 80 is illustrated in FIG. 13, molding clip 82 is illustrated in FIG. 14 and molding clip 84 is illustrated in FIG. 15. Referring to FIGS. 16 through 18, male members, hereinafter referred to as molding clip holder assemblies 86, are used to secure the above identified molding clips in position. Referring to FIG. 11, locator tacks 106 are used to locate the mounting positions of male snaps 44.

Figure 3:
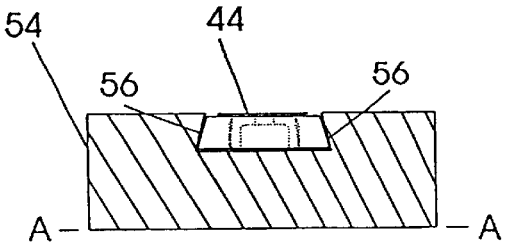
FIG. 3 is an end elevation view of a fastener engaged with molding, as in FIG. 1.

Referring to FIG. 1, molding 54 must be of adequate thickness so that the dovetail groove 48 does not adversely affect the strength requirements of the molding 54. The groove 48 will have bevelled sides 56 which slope outwards and which meet on the same plane 50 at the bottom of the groove. Referring to FIG. 3, the bevelled sides 56 must be of sufficient depth to accept the full length of the circular male snap 44. Referring to FIG. 1, although a number of "pockets" could be used, it is preferred that the plane surface 50 of the groove 48 will be of constant depth over the entire length of the molding 54 and will be a consistent parallel distance/width from edges 58 and 52 over the entire length of the molding 54.

Figure 9:
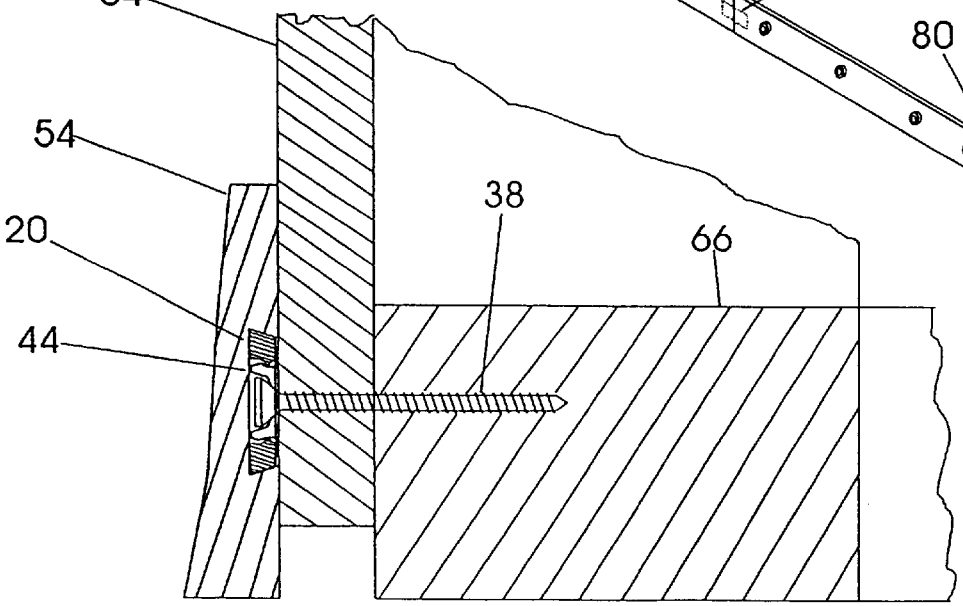
FIG. 9 is a cut away side elevation view of the installed molding illustrated in FIG. 8.
Figure 10:
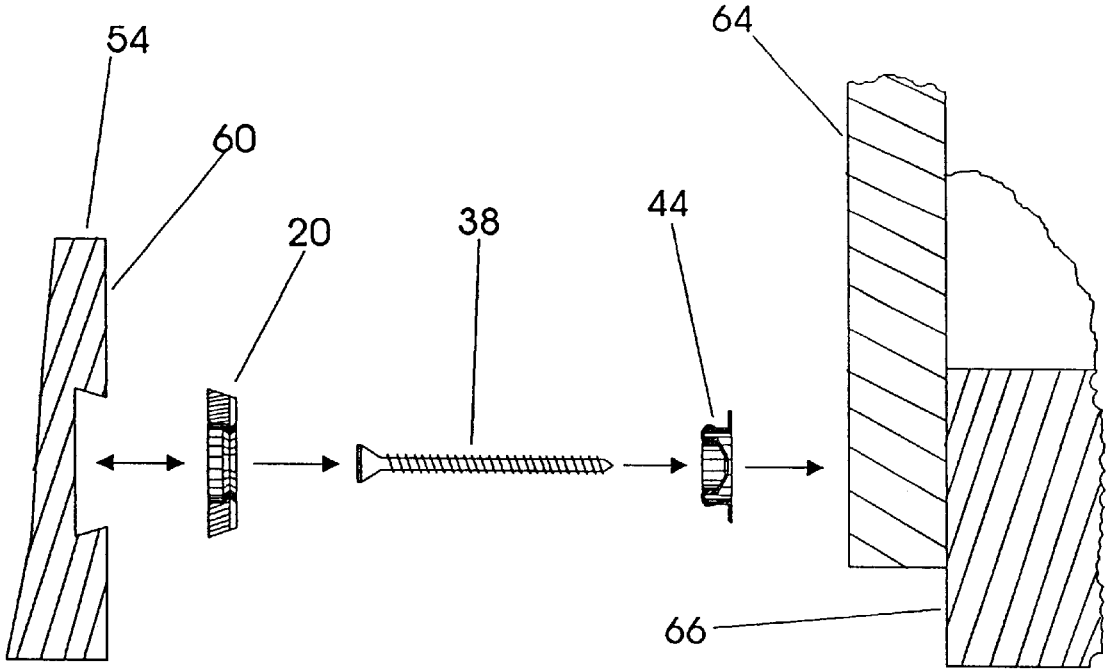
FIG. 10 is an exploded side elevation view of the installed molding illustrated in FIG. 9.

Referring to FIGS. 1, 9, and 10, circular male snap 44, made of body 42, will be fastened to the desired flat surface 64 by screw/nail 38. The male snap 44 and screw/nail 38 will be attached to the flat surface 64 in such a manner that it will match with the positioning of the female molding snap 20 in the molding 54. When attaching the screw/nail 38 and male snap 44 to a flat surface 64 the base of male snap 44 must be snug/flush with the flat surface 64.

Figure 5:
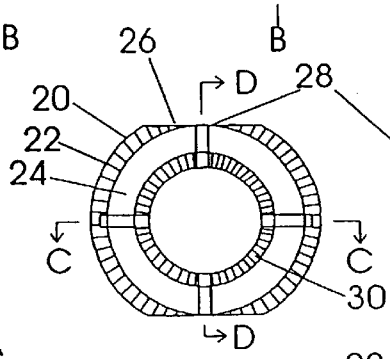
FIG. 5 is a top plan view of the female portion of the fastener.
Figure 6:
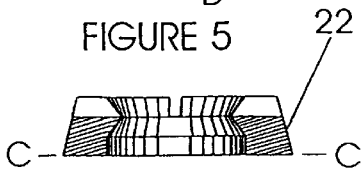
FIG. 6 is a cut away end elevation view of the female portion of the fastener, as in FIG. 5.
Figure 7:
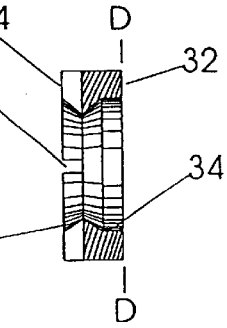
FIG. 7 is cut away side elevation view of the female portion of the fastener as in FIG. 5.
Figure 8:
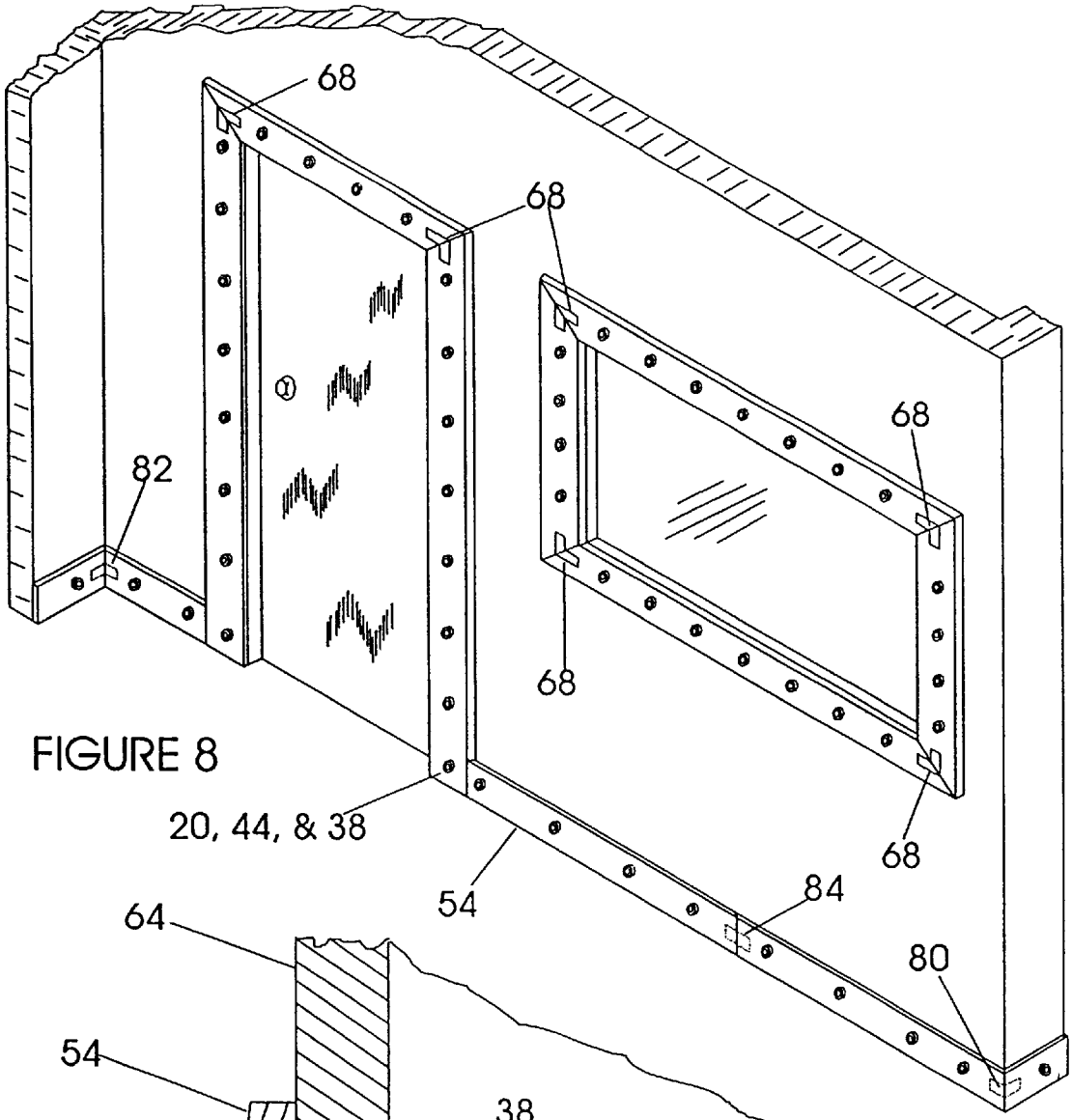
FIG. 8 is a perspective view of a molding installed using the molding fastener system.

Referring to FIGS. 5 through 7, female molding snap 20 is made of flat sides 26, bevelled sides 22, expansion grooves 28, circular opening 30 and consists of flat top 24 and flat bottom 32. The sides will consist of flat sides 26 and bevelled sides 22 and both are of approximate depth of the molding groove 50 plus the base of the circular male snap 44. The thickness or depth of female molding snap 20 will correspond with the difference in depth of the molding groove 48 and the base of the male snap 44. The hole in the geometric center of the female molding snap 20 has bevelled sides and diameter 30 and be of adequate size to be smaller in diameter than the snap end of circular male snap 44. The female molding snap 20 will be positioned on molding 54 to match the position of male snap 44 and screw/nail 38. Side width bevelled dimension C—C in FIG. 6 of female molding snap 20 is slightly larger than the inside bevel width 56 of the molding groove 48. Side width dimension D—D in FIG. 7 of female molding snap 20 is slightly smaller than side dimensions from 52 to 58 of molding groove 48. The female molding snap 20 has a smaller inside diameter of bevelled lip 30 than the head diameter 40 of male snap 44. The diameter 34 at the bottom of female molding snap will be slightly larger than diameter 40 of male snap 44. The small grooves 28 on the top of female molding snap 20 will be of sufficient depth, width and number to enable the bevelled diameter 30 to expand enough to allow the end 40 of male snap 44 to be inserted with sufficient force. Bevelled diameter 30 is designed to force the base 46 of male snap 44 against flat top 24 of female molding snap 20. The small grooves 28 also accommodate a tip of a screw driver (not shown). It is preferred that the bevelled sides 22 have very small raised ridges (not shown) which extend from the flat top 24 and flat bottom 32 of female molding snap 20. These ridges assist in obtaining a snug friction fit between female snap 20 and molding groove 48.

Figure 2:
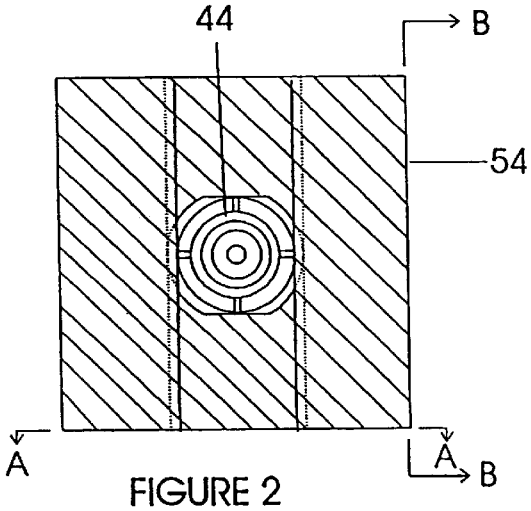
FIG. 2 is a top plan view of engaged fastener with molding, as in FIG. 1.
Figure 4:
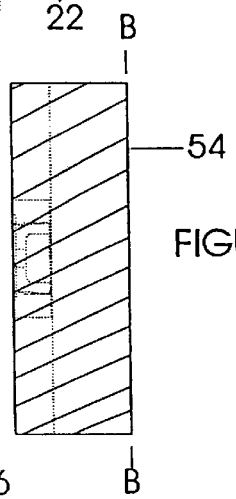
FIG. 4 is a side elevation view of engaged fastener with molding, as in FIG. 1.

Referring to FIG. 2, female molding snap 20 is first inserted in molding groove 48 with dimension D—D in FIG. 7, parallel with sides 52 and 58 of molding groove 48. The female molding snap will be turned by one quarter turn such that dimension C—C in FIG. 6 is parallel to sides 52 and 58 of molding groove 48 such that the female molding snap is fitting snugly in groove 48. Referring to FIG. 3, when the female molding snap 20 is properly installed it will resist movement in the molding groove 48 unless sufficient force is applied.

Referring to FIG. 9, once the female molding snap 20 is in place and is aligned with the male snap 44 (which is securely fastened to a flat surface 64), the molding 54 can then be snapped securely to the male snap 44 on the flat surface 64. The amount of snap assemblies will be determined by the fit between the molding 54 and flat surface 64, and the limit of installed snaps will be based on the assembly length and molding 54 length. It is expected that the number of fasteners on a molding 54 would be similar to the number of fasteners required if the molding 54 were nailed, stapled or screwed.

The molding clips 68, 80, 82, and 84 as shown in FIGS. 12, 13, 14 and 15 are inserted into the two matching corresponding molding 54 pieces which can meet in any manufactured angle in flat corners, internal and external corners or in straight run lengths. The desired effect holds two opposing pieces of molding 54 together such that when molding clip holder assemblies 86 are inserted in each end of the molding clip it securely holds the clips 68, 80, 82 and 84 and securely holds two pieces of molding 54 together. Each molding clip of bodies of 68, 80, 82, and 84 will consist of flat tops 70 and sides 78. The sides will consist of legs 74 which are of approximate depth of the molding groove 48 and a leg 76 which extends outward to be in close tolerance to the base of the molding groove 50. The top of the molding clips will consist of top 70 and sides 78. The sides 70 will be in close tolerance with the sides of molding groove 56. The thickness or depth of the molding clips 68, 80, 82 and 84 will be less than, but in close proximity in depth of the molding groove 50. When molding clips 68, 80, 82 and 84 are installed properly they will be inserted such that each matching molding will meet each other in a snug secure manner.

Referring to FIGS. 16 through 18, the molding clip holder assembly of body 86 is of sufficient depth 96 to slide conformably inside the molding clips 68, 80, 82 and 84 and be of a height dimension slightly less than depth 74. The molding clip holder assembly 86 has a flat top 98 and bottom 100. It has sides 96 which have rounded insertion ends 92 and of width 102 and 104 such that it is slightly larger than the side dimensions 78 of the molding clips 68, 80, 82 and 84 and when the molding clip assembly 86 is inserted in the molding clips 68, 80, 82 and 84 it forces the sides 76 into the bottom of the dove tailed groove 50 of the molding 54. The molding clip holder assembly 86 will have an end 94 which will have a width wider than the inside dimension of 78 such that when it is inserted it will not fully enter the molding clips 68, 80, 82 and 84. There will be a groove 88 which will remain exposed once the molding clip holder assembly 86 is inserted in the molding clips 68, 80, 82 and 84, the molding clip holder assembly 86 can then be easily removed by sliding it out by using the groove 88 to hang on to.

Referring to FIG. 11, male snap locator tack 106 of pointed end 108 and flat base 116 will be made of a strong high tensile strength metal which will have the ability to penetrate any flat surfaces 64 as desired for molding installation. It will have dimensions such that the base 116 will have a diameter such that it is smaller than the bevelled diameter 30 of the female molding snap 20. The height of the pointed end 108 will be more than the height of the groove 48 of sides 56 such that when the molding 54 is resting on a flat surface 64 and is struck with the palm of a hand, the male snap locator tack 106 will stick into the flat mounting surface 64. A small centering washer 112 will be made of a soft resilient material such that the pointed end 108 of the male snap locator tack 106 fits snugly in the hole 110 in the geometric center of the flat sides 114 of the washer 112. The washer 112 will have a height and diameter such that when it is placed over the male snap locator tack 106 and when they are both inserted into a female molding snap 20, it will sit inside the bevelled diameter 30 such that it is unable to fall out and is held securely enough to keep it there while the molding 54 is put into position on the flat mounting surface 64. After the molding 54 is hit sufficiently hard enough by the palm of a hand the centering washer will be released from the bevelled hole 30 of the female molding snap after the male molding snap locator tack is forced into the flat mounting surface 64. Even if the male snap locator tack 106 does not stick into flat mounting surface 64 it will leave a visible marked location for the male snap 44 and mounting screw or nail 38. The male snap locator tack 106 and centering washer 112 can be kept and used for many molding installations.

Referring to FIG. 3, the molding groove 48 with bevelled (dovetail) sides 56 enables the female molding snap 20 to be held securely in the molding. The desired effect is to obtain a flush fit between a flat mounting surface and the back of the molding 60. To obtain a flush fit the total depth of the molding groove 54 will be equal to the cumulative thickness of base of male snap 44 and thickness of female molding snap 20.

The molding 54 may be made of any type of material, and is not limited to materials the same or similar to existing manufactured molding. The molding can be made of any type of material, as long as the material is resilient enough to hold female molding snap 20. This enables materials to be used that previously would not have been viewed as suitable. The circular male snap 72 may be made of plastic or metal, but it must incorporate a thin flat base and a hole in the middle for use in attaching to a flat surface 64 with nail or screw 38. Nail or screw 38 will be made of metal and will consist of a head 36 which will fit inside the head of circular male snap 44. The nail or screw will be of sufficient length to accomplish a snug fit between the base of the circular male snap 46 and the flat mounting surface 64. In the case that normal gyp rock (wallboard) is the flat surface 64, the nail or screw 38 will be required to penetrate solid backing behind the wall board 66. Where a screw wall anchor is employed, then a screw 38 of sufficient length and head 36 must be used to attach the circular male snap 44.

Referring to FIG. 1, the female molding snap 20 will be made of any type of material which is resilient enough to sit conformably on flat molding surface 50. The female molding snap 20 will preferably be made of a resilient plastic material, which can be formed or machined. The key elements of the female molding snap are; flat sides 26, bevelled sides 22, and the grooves 28 which allow the smaller diameter with bevelled edges 30 to accept and hold the male snap 44. The shape and dimensions of the female molding snap 20 create the snug fit between it and the molding 54. The female molding snap 20 is fit securely within the molding groove 48 by inserting it in the groove with the flat sides of the snap 26 parallel the sides of the groove 52 and 58 and then turning the snap one quarter turn. The total size and dimensions of the female molding snap 20 will be determined by the size of the molding groove 48 and the male snap 44 used. It is anticipated that a standard size of grooves 48 would be made in molding or trim and the snaps would be a standard size so that there would not be errors associated with having different sized grooves 48. The female molding snap 20 can also be made of any other resilient material which also has the flexibility so that it can expand enough in the inside bevelled diameter 30 to accept the male molding snap 44.

Referring to FIGS. 11 through 16, the molding clips 68, 80, 82, and 84 will preferably be manufactured using a thin metal material or plastic to allow it to expand and grip the base of the molding groove 50 and be resilient enough to hold and accept the molding clip holder assembly 86. The thickness or depth of the molding clips 68, 80, 82, and 84 will be determined by the depth of the groove 50 in the molding 54. Preferably a thin but high tensile strength metal or plastic will be used to allow the clips with sides 78 to spring back to original position when molding clip holder assemblies are removed allowing the clips to slide freely from the ends of the molding grooves 50.

Referring to FIGS. 16 through 18, the molding clip holder assembly 86 will likely be made out of plastic or metal, which will allow it to be easily inserted or withdrawn from the molding clips 68, 80, 82 and 84. It must be of dimensions and resilient enough to force the sides 78 of the molding clips 68, 80, 82 and 84 into the sides of the molding groove 50 securely.

Figure 19:
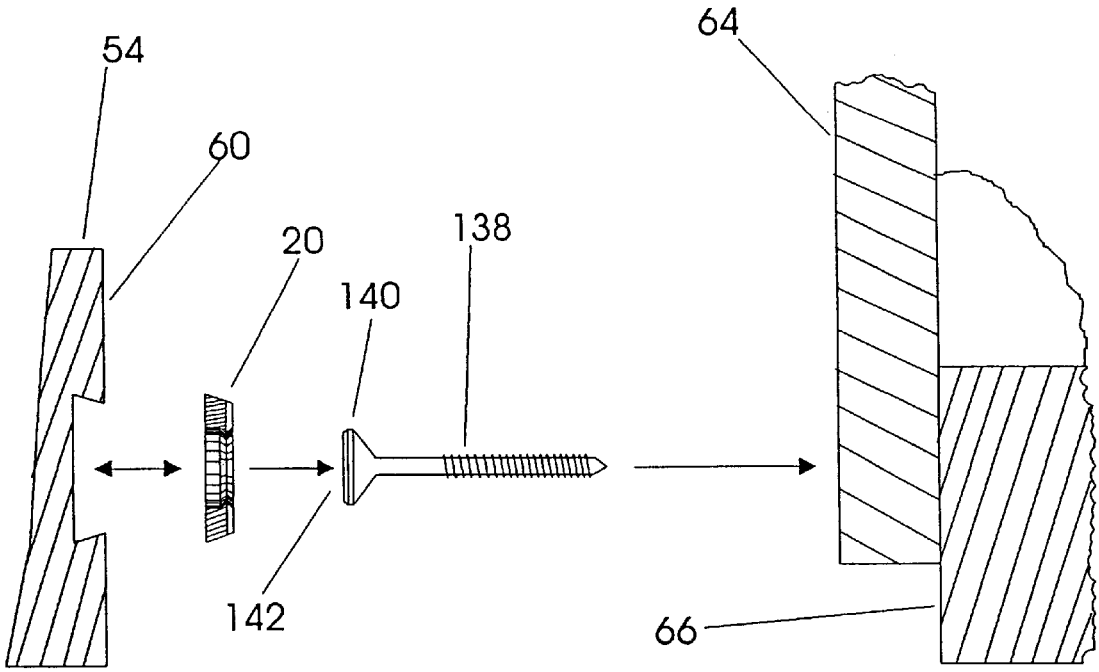
FIG. 19 is an exploded side elevation view, in section, of an alternative embodiment of molding system constructed in accordance ith the teachings of the present invention.
Figure 20:
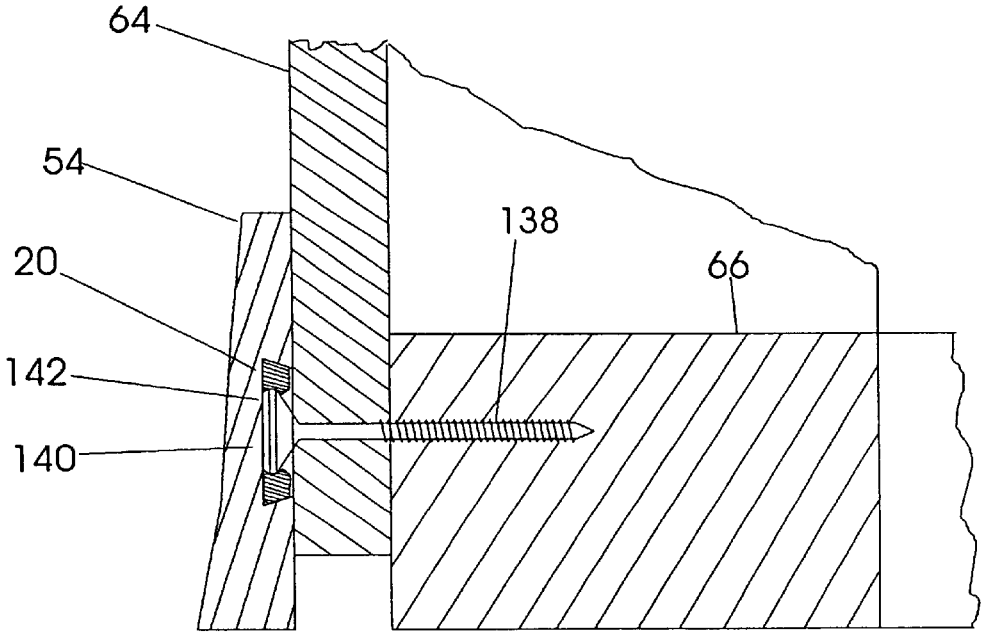
FIG. 20 is a side elevation view, in section, of the alternative embodiment of molding system illustrated in FIG. 19.

Referring to FIGS. 19 and 20, there is illustrated how the male component can be incorporated as part of a fastener 138, such as a nail or a screw or a wall anchor. Male fastener 138 has a flat head 142 and a round bevelled diameter 140. Male fastener 138 is securely fastened to flat surface of wallboard 64 and extends into solid backing 66 behind wallboard 64. Molding 54 is then secured in place by snapping female molding snap 20 onto head 142. The depth of penetration of male fastener 138 relative to flat surface 64 will be selected according to the depth of molding groove 48, so that head 142 protrudes from flat surface 64 a distance closely approximating the depth of molding groove 48. With this system, the distance of head 142 from surface 64 can be varied. This provides an advantage when an installer discovers that a portion of surface 64 is not completely flat. By adjusting the depth of penetration of male fastener 138, the irregularity or defect can be accommodated.

It will be apparent to one skilled in the art that the profile of retaining groove 48 can change as long as there is a corresponding change to the profile of the female snap component. It will also be apparent to one skilled in the art that other modifications may be made to the illustrated embodiment without departing from the spirit and scope of the invention as hereinafter defined in the claims.

What is claimed is:

1. An apparatus for mounting architectural moldings, comprising, in combination:

an elongate molding with at least one longitudinally extending retaining groove, the retaining groove having a base portion that defines a bottom width, sidewalls and a terminus of the sidewalls that defines a top width, the top width being narrower than the bottom widths and a two part fastener having a unitary female portion and a male portion, the female portion being asymmetrical with a first width in a first direction that is less than the top width of the retaining groove and a second width in a second direction that is larger than the top width of the retaining groove and substantially the same as the bottom width, such that the female portion of the two part fastener passes freely through the top width when oriented in the first direction and becomes wedged within the retaining groove when rotated until substantially oriented in the second direction.

2. The apparatus as defined in claim 1, wherein the female portion has a surface profile that accommodates a tool and permits the female portion to be rotated by the tool.

3. The apparatus as defined in claim 1, wherein the female portion of the two part fastener has sidewalls defining the second width which converge inwardly from a first face toward a second face, the first face having a width substantially con-responding, to the bottom width of the retaining groove, and the second face having a width substantially corresponding to the top width of the retaining groove.

4. The apparatus as defined in claim 1, wherein a clip member is insertable into the retaining grooves at a first end of a first molding and at a second end of a second molding, the clip member having flexible sidewalls defining a channel, the clip member being secured in position within the retaining groove of the first molding by inserting a first clip holder into the channel to expand the flexible sidewalls outwardly to engage the retaining groove, the clip member being being secured in position within the retaining groove of the second molding by inserting a second clip holder into the channel to expand the flexible sidewalls outwardly to engine the retaining groove.

5. The apparatus as claimed in claim 4, wherein the clip member has sides with rough edges such that when they are forced into interior sides of the groove in the molding that it will resist movement between the clip member and the molding.

6. The apparatus as claimed in claim 4, wherein the clip holder has flat tops and bottoms which are of constant width and thickness over most of the length of the clip holder and of a width slightly larger than an inside width dimension of the clip member such that when the clip holder is inserted in the clip member it forces the sides of the clip member outwardly to engage the retaining groove in the molding.

7. The apparatus as claimed in claim 1, wherein the retaining groove is of constant depth and width and extends an entire length of the molding.

8. The apparatus as claimed in claim 1, wherein the male portion of the two pall fastener is circular in shape and has a thickness that is less than a depth of the retaining groove.

9. The apparatus as claimed in claim 1, wherein the male portion of the two part fastener has a base that is of smaller diameter than the top width of the retaining groove.

10. The apparatus as claimed in claim 1, wherein a head of the male portion of the two part fastener obtains a friction fit between the portion and the male portion of the two part fastener.

11. The apparatus as claimed in claim 1, wherein a center circular portion of the male portion of the two part fastener has a recessed lip to accept full penetration of and holding of one of a nail and screw.

12. The apparatus as claimed in claim 1, wherein the female portion of the two part fastener has a circular hole positioned in a geometric center of and fully penetrating the female portion.

13. The apparatus as claimed in claim 12, wherein the female portion has a small bevelled ridge in the hole though the geometric center and the ridge has a diameter such that the male portion has to be pushed with adequate force to penetrate it and it should be positioned in the penetrating hole such that when the male portion is inserted, a base of the male portion will hold securely to a top of the female portion.

14. The apparatus as claimed in claim 12, wherein a top of the female portion will have adequate grooves to allow the bevelled ridge within the penetrating hole to expand sufficiently to allow insertion of the male portion.

15. The apparatus as claimed in claim 1, wherein the female portion has two flat vertical sides defining the first width which are opposite each other and the distance between the two flat sides is slightly less than the top width of the retaining groove.

16. The apparatus as claimed in claim 1, wherein the female portion has two bevelled sides defining the second width which are opposite each other, at the same angle as the grooved sides of molding and they are of the distance apart such that when the female portion is turned one quarter turn in the molding it will wedge securely inside the retaining groove.

17. The apparatus as claimed in claim 1, wherein a locator tack is provided having a base of sufficient size to fit inside the hole of the female portion and a sharp point which is longer than the height of the groove in the molding.

18. The apparatus as claimed in claim 17, wherein the clip holder has a groove positioned on the top, thereby enabling a tool to be inserted in the clip holder to facilitate its removal from the clip member.

19. The apparatus as claimed in claim 17, wherein a centering washer is provided that fits over the point of the locator tack, the washer being of a height which matches the height of the bevelled inside diameter of the female portion and having an outside diameter which fits snugly in the inside of the hole of the female portion.

20. The apparatus as defined in claim 1, wherein the male portion of the two part fastener is integrally formed as a head of one of a nail, a screw and a wall anchor.

* * * * *

UNITED STATES PATENT AND TRADEMARK OFFICE

CERTIFICATE OF CORRECTION

PATENT NO. : 6,286,286 B1
DATED : September 11, 2001
INVENTOR(S) : D.M. Simonar

It is certified that error appears in the above-identified patent and that said Letters Patent is hereby corrected as shown below:

Column 8,
Line 66, “bottom widths” should read -- bottom width; and --

Column 9,
Line 19, “con-responding, to” should read -- corresponding to --
Line 33, “engine” should read -- engage --
Line 50, “pall” should read -- part --

Column 10,
Line 3, “between the portion” should read -- between the female portion --

Signed and Sealed this

Fifth Day of August, 2003

JAMES E. ROGAN
*Director of the United States Patent and Trademark Office*